United States Patent [19]

Crawford et al.

[11] 3,980,478

[45] Sept. 14, 1976

[54] METHOD OF MAKING AN ULTRAVIOLET LIGHT IMAGE RECORDING USING A VISIBLE-LIGHT REFLECTIVE INTERMEDIATE ELEMENT

[75] Inventors: Irvin H. Crawford, Hamlin; Ronald A. Wellman, Rochester, both of N.Y.

[73] Assignee: Eastman Kodak Company, Rochester, N.Y.

[22] Filed: July 5, 1974

[21] Appl. No.: 485,697

[52] U.S. Cl. ..... 96/27 R; 96/48 R; 96/49; 96/75; 96/85

[51] Int. Cl.[2] ..... G03C 5/18

[58] Field of Search ..... 96/49, 48 R, 50 R, 47, 96/75, 85, 27 R

[56] References Cited

UNITED STATES PATENTS

| | | | |
|---|---|---|---|
| 2,603,564 | 7/1952 | Maxcy | 96/75 |
| 2,606,117 | 8/1952 | Trojner | 96/75 |
| 2,908,572 | 10/1959 | Schoen et al. | 96/49 |
| 2,942,975 | 6/1960 | Eerde | 96/85 |
| 2,953,471 | 9/1960 | Landau | 96/75 |
| 2,964,403 | 12/1960 | Beekman et al. | 96/85 |
| 2,980,534 | 4/1961 | Printy et al. | 96/85 |
| 3,411,908 | 11/1968 | Crawford et al. | 96/85 |
| 3,520,242 | 7/1970 | Kemp et al. | 96/85 |
| 3,647,454 | 3/1972 | Hunter | 96/75 |
| 3,783,003 | 1/1974 | Matsuhisa et al. | 96/75 |
| 3,833,380 | 9/1974 | Crawford et al. | 96/85 |

*Primary Examiner*—Charles L. Bowers, Jr.
*Attorney, Agent, or Firm*—T. N. Dahl

[57] ABSTRACT

Images are recorded on ultraviolet-light sensitive recording materials employing photographic intermediates which function optically to reflect visible light and transmit ultraviolet light. To give the intermediates the desired optical function, a polyolefin compounded with certain white pigments is included as a sublayer between the paper support sheet and photosensitive layer.

4 Claims, 1 Drawing Figure

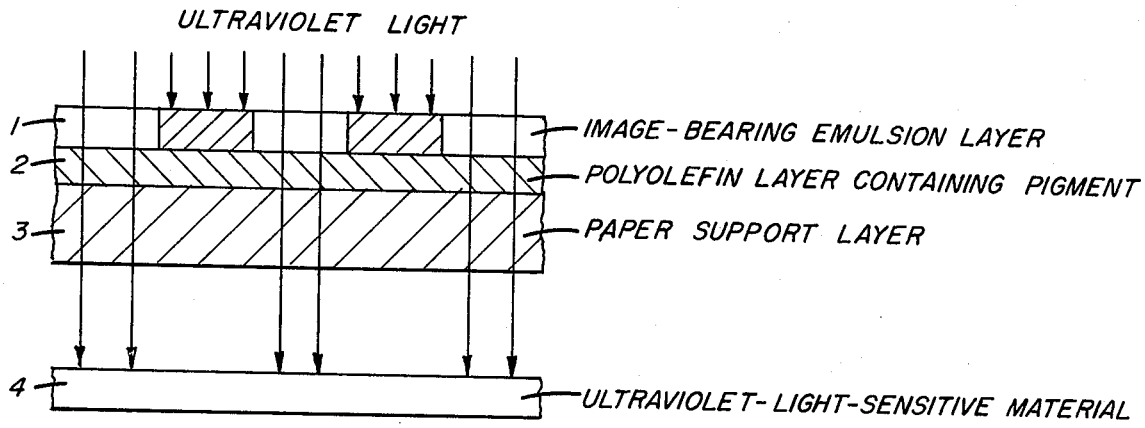
ULTRAVIOLET LIGHT
1
2
3
4
IMAGE-BEARING EMULSION LAYER
POLYOLEFIN LAYER CONTAINING PIGMENT
PAPER SUPPORT LAYER
ULTRAVIOLET-LIGHT-SENSITIVE MATERIAL

METHOD OF MAKING AN ULTRAVIOLET LIGHT IMAGE RECORDING USING A VISIBLE-LIGHT REFLECTIVE INTERMEDIATE ELEMENT

BACKGROUND OF THE INVENTION

1. Field of the Invention

This invention relates to the field of ultraviolet-light image recording, and more particularly to methods of recording images with ultraviolet light utilizing photographic elements containing certain white pigments.

2. Description of the Prior Art

In various fields of endeavor involving valuable documents, manuscripts, drawings, etc. which do not readily lend themselves to frequent handling, the preparation of large numbers of copies is made practical by means of photographic intermediates. These intermediates are employed in ultraviolet recording systems such as the diazo process, which uses diazonium salt ultraviolet-light sensitivity for image recording.

Typically, such intermediates are first exposed to form a latent image from line originals, such as engineering drawings, using white light as an exposing source. The latent-image-bearing intermediates are developed to images using common development techniques depending on the particular sensitized emulsion employed. After development, the intermediates are employed as transparencies in the imagewise exposure of ultraviolet-light-sensitive material to ultraviolet radiation, producing the desired copies or "print-outs."

Accordingly, in the foregoing context, intermediates must meet two important photographic requirements. They must be capable of reproducing originals with acceptable line resolution, as perceived by the naked eye. They must also, as developed intermediates, be capable of transmitting ultraviolet light in non-image areas so as to give reasonable exposure times in producing copies.

In the prior art, intermediates of the type containing film support sheets, in addition to at least one emulsion layer sensitive to visible light, fulfill both above requirements. Typically, the film is such material as cellulose ester, glass-filled polyester base, saponified cellulose acetate, vinyl polymers, polycarbonates, and the like. Glassine paper-polyethylene laminates, such as disclosed in U.S. Pat. No. 3,260,602 to Wood et al, are also used for the support but suffer the disadvantages of less acceptable image resolvability. Furthermore, intermediates containing either film or the aforesaid glassine laminate supports are expensive.

Less costly intermediates are available containing paper supports. Common photographic paper support stock is typically used. However, while they are ultraviolet light transmitting, intermediates containing paper supports are less acceptable in their ability to resolve images. Accordingly, it is an objective of this invention to enhance image resolvability of intermediates containing paper supports, without sacrificing reasonable ultraviolet light transmissability requirements.

Usually, when enhanced image resolution is an objective, it is obtained in the art by the addition of functional amounts of highly white-light reflective pigments to a sublayer between the support and the photosensitive emulsion layer. Illustrative examples of such pigments are titanium dioxide, zinc oxide, zinc sulfide, zirconium dioxide, white lead, lead sulfate, lead chloride, lead aluminate, lead phthalate, antimony trioxide, tin oxide, white bismuth, white tungsten and white manganese. Some or all of these materials are also known for other photographic related properties such as emulsion adherence, opacification, reflectance, and stabilization, about which French Pat. Nos. 2,114,360 and 2,099,168, U.S. Pat. No. 3,169,865 and British Pat. No. 1,237,164 are illustrative. There is no suggestion in the art that pigmented elements can, in addition to resolving images, transmit reasonable amounts of ultraviolet light. Furthermore, titanium dioxide, an excellent image-resolving agent, is disadvantageously highly absorbent of ultraviolet light.

It has now been discovered that certain pigmented polyolefin layers give both photographic optical functional requirements when contained within these intermediates. By incorporating effective amounts of zinc sulfide or zirconium dioxide in a polyolefin sublayer between the paper support and the photosensitive emulsion layer, image resolution by high white-light reflectivity is predictably enhanced, and, unexpectedly, the intermediate is ultraviolet-light-transmitting.

SUMMARY OF THE INVENTION

Imagewise exposure of an ultraviolet-light-sensitive material is carried out utilizing an image-bearing intermediate containing a paper support and a polyolefin layer pigmented with zinc sulfide or zirconium dioxide in white-light-reflecting and ultraviolet-light-transmitting proportions.

DESCRIPTION OF THE PREFERRED EMBODIMENTS

The present invention is conveniently carried out in any of several conventional systems that utilize ultraviolet light, in the range from about 300 to 460 nm (nanometers), to expose ultraviolet-light-sensitive film or paper. Preferred is the diazo process in which imagewise exposure is performed using radiation from a mercury lamp, a carbon arc lamp, or a thorium doped mercury lamp. After exposure, the ultraviolet-light sensitive film or paper is developed in a customary manner. In the diazo process, such development is typically dry, semi-wet or thermal and may be positive or negative acting. The diazo process is more fully described in *Light Sensitive Systems; Chemistry ɜ Application of Non-Silver-Halide Photographic Processes* by Kosar (John Wiley & Sons, Inc., 1965 Edition).

An essential feature of this invention is ultraviolet light exposure, as above defined, employing an image-bearing intermediate which is uniquely white-light-reflecting, and ultraviolet-light-transmitting in non-image areas.

With reference to "white-light-reflecting" and "ultraviolet-light-transmitting" the following criteria apply. Inasmuch as it is an objective herein to improve the sharpness or resolution of images as recorded on intermediates comprising, in part, a paper support, as defined below, the quality of white-light-reflecting is achieved when any improvement of resolution is detected by the naked eye. Ultraviolet-light-transmitting is defined with reference to the process of ultraviolet light recording. That is, a reasonable degree of ultraviolet-light transmission, as measured by a reasonable processing speed required to produce prints of a preselected density, is considered ultraviolet-light-transmitting. Therefore, if an intermediate is both white-light-reflecting and ultraviolet-light-transmitting it provides sharper images than intermediates of the same or similar structure but free of pigments, and will transmit in non-image areas a reasonable amount of incident ultraviolet light. One skilled in the art will readily appreciate that "reasonable" will depend entirely on the exigencies at hand with the only limitation being that the intermediate be also white-light-reflecting.

The intermediate of this invention is comprised of (a) a paper support suitable for use in ultraviolet-light imaging processes, (b) an image-bearing emulsion layer, and (c) a white-light-reflecting, ultraviolet-light-transmitting, polyolefin layer between the support and emulsion layer, containing effective amounts of zinc sulfide or zirconium dioxide. Other functional layers known in the photographic arts, may also be added provided they are compatible with white-light-reflectivity and ultraviolet-light-transmissability. Typical additional layers are, for example, anticurl coatings, polyolefin back coatings, subbing layers, baryta coatings and the like.

Any of the known paper or paper-containing supports, which are suitable for use in ultraviolet-light imaging processes, are operable in the intermediate of the present invention. Preferred are common photographic papers. The weight and thickness of the support are variable depending on the particular operational needs of the user. A preferred weight range is from about 10 lbs./1000 sq. ft. to about 25 lbs./1000 sq. ft. Preferred thicknesses are those corresponding to commercial grade photographic paper, typically from about 2.5 mils (0.0025 inches) to about 6.5 mils (0.0065 inches).

Carried by the paper support sheet is an image-bearing emulsion layer obtained from the white-light exposure and development of a light-sensitive emulsion layer. In the preferred embodiment, a high contrast projection speed light-sensitive silver chlorobromide emulsion is employed. However, other light sensitive emulsion which can be developed into image-bearing layers can be employed so long as they are compatible with ultraviolet-light imaging processes.

As the polyolefin layer, it is permissible to use any coatable polyolefin material known in the photographic art. Representative of these materials are polyethylene, polypropylene, polybutylene, and mixed polyolefins, of which polyethylene is preferred. Most preferred is either low or medium density polyethylene. The coating coverage is limited to that which, when compounded with either zinc sulfide or zirconium dioxide, below described, will give the functional effects of white-light-reflecting and ultraviolet-light-transmitting as defined. Preferably, a coating of from about 1.5 lbs./1000 sq. ft. to about 5.0 lbs./1000 sq. ft., is employed. About 2.5 lbs./1000 sq. ft. is most preferred.

It is important, to achieve the desired optical effects, that the polyolefin layer be situated within the intermediate between the support sheet and image-bearing layer.

To obtain white-light-reflecting and ultraviolet light-transmitting properties, either zinc sulfide or zirconium dioxide or mixtures of zinc sulfide and zirconium dioxide, in effective amounts, is blended into the polyolefin layer. This, of course, is done by any conventional means, prior to coating. The pigment used is in any form that is conveniently dispersed within the polyolefin.

An "effective amount" of either pigment is that amount which will give both white-light-reflecting and ultraviolet-light-transmitting qualities to the intermediate. With a particular choice of paper support, one need merely add that quantity of pigment which will give to the intermediate both the improved resolving characteristics when compared with those of an intermediate of the same or similar structure having neither of the above pigments, and ultraviolet-light-transmitting properties as defined.

Good results are obtained with zinc sulfide at a concentration of from about 5 percent to about 10 percent, or with zirconium dioxide at a concentration of from about 12 percent to about 18 percent, based on the mixture weight of polyolefin and pigment into which either pigment is blended. Particularly good results are achieved when zinc sulfide is present at a concentration of about 7 percent, or zirconium dioxide is present at about 14 percent.

It may also be desirable, as the skilled artisan will appreciate, to incorporate, within the pigmented polyolefin layer, stabilizers, release agents, or the like, which will not interfere with the desired optical properties.

The following examples are intended to illustrate the invention but not to limit it in any way.

EXAMPLE 1

Intermediates A, B and C are each sensitized with a high contrast projection speed light-sensitive silver halide emulsion. Intermediate A is comprised of a sheet of 15 lbs./1000 sq. ft. photographic paper of 3.6 mil thickness, a face side coat of 4.3 lbs./1000 sq. ft. baryta, a next face side coat of 0.01 lbs./1000 sq. ft. polyethylene imine primer, a next face side coat of 2.5 lbs./1000 sq. ft. unpigmented, low density polyethylene, a wire side coat of 0.01 lbs./1000 sq. ft. polyethylene imine primer, a next wire side coat of 5.5 lbs./1000 sq. ft. unpigmented high density polyethylene, and a final anti-curl wire side coat. Intermediates B and C are each comprised of the same paper support as intermediate A, face side coated with 2.5 lbs./1000 sq. ft. of pigmented medium density polyethylene and wire side coated with 5.0 lbs./1000 sq. ft. unpigmented high density polyethylene. Intermediate B contains 7 percent zinc sulfide and intermediate C contains 14 percent zirconium dioxide, based on the mixture weight of medium density polyethylene and pigment. Intermediate D is a conventional line reproduction paper such as KODAGRAPH Super K Translucent Paper KCT-4, and contains a glassine-polyethylene laminate support and a photosensitive emulsion such as employed herein.

The four intermediates are exposed to the same engineering drawing, using white light from a tungsten lamp, and subsequently developed. To the naked eye, intermediates B and C have sharper, more resolved, images than those of either intermediates A or D.

EXAMPLE 2

Developed intermediates A, B, C and D are each employed in a diazo process machine to produce diazo copies of the same density. Processing speeds of either intermediate B or C are comparable to the processing speeds of either intermediate A or D, all speeds ranging from about 11 to about 25 feet per minute.

The accompanying drawing shows in greatly enlarged cross-sectional view a representative intermediate of the present invention wherein ultraviolet light striking image-bearing emulsion layer 1 passes through non-image areas and continues to pass unimpeded through both the polyolefin layer 2 containing pigment herein described, and paper support sheet 3, thereby recording the desired image onto ultraviolet-light-sensitive material 4.

The invention has been described in detail with particular reference to preferred embodiments thereof, but it will be understood that variations and modifications can be effected within the spirit and scope of the invention as described hereinabove and as defined in the appended claims.

What is claimed is:

1. A method of ultraviolet light recording of an image comprising (1) imagewise exposing with ultraviolet radiation a diazo recording material which is sensitive to ultraviolet radiation, through an image-bearing photographic intermediate comprising:

a. a paper support, b. a silver image-bearing emulsion layer, and c. a layer of polyolefin between said support and said emulsion layer, that contains zinc sulfide dispersed therein and is coated at a coverage from about 1.5 lbs./1000 sq. ft. to about 5 lbs./1000 sq. ft., said photographic intermediate exhibiting improved resolution of line images compared to a photographic intermediate of the same structure which is free of said zinc sulfide, and being capable of transmitting ultraviolet radiation and (2) processing such recording material to a visible image.

2. A method of claim 1 wherein said polyolefin layer contains from about 5 percent to about 10 percent of zinc sulfide based on the mixture weight of polyolefin and zinc sulfide.

3. A method of claim 2 wherein said zinc sulfide concentration is about 7 percent.

4. A method of claim 3 wherein said polyolefin layer is about 2.5 lbs./1000 sq. ft. of medium density polyethylene.

* * * * *